United States Patent [19]

Twigger

[11] Patent Number: 4,757,877

[45] Date of Patent: Jul. 19, 1988

[54] SUPPORTING ELEMENT

[76] Inventor: Ronald T. Twigger, 19 Adelaide Close, Durrington, Worthing, England

[21] Appl. No.: 76,042

[22] Filed: Jul. 21, 1987

[30] Foreign Application Priority Data

Jul. 27, 1986 [GB] United Kingdom ..... 8618175

[51] Int. Cl.[4] ..... B27B 21/00

[52] U.S. Cl. ..... 182/186; 182/226

[58] Field of Search ..... 182/181–186, 182/224, 226

[56] References Cited

U.S. PATENT DOCUMENTS

| | | | |
|---|---|---|---|
| 1,153,470 | 9/1915 | Wagner | 182/226 |
| 2,416,950 | 3/1947 | Pohrman | 182/186 |
| 3,212,606 | 10/1965 | Spaw | 182/186 |
| 3,809,183 | 5/1974 | Lowd | 182/186 |
| 4,008,786 | 2/1977 | Canavan | 182/186 |
| 4,248,326 | 2/1981 | Hansen | 182/226 |

FOREIGN PATENT DOCUMENTS

| | | | |
|---|---|---|---|
| 359872 | 3/1962 | Switzerland | 182/186 |

*Primary Examiner*—Reinaldo P. Machado

*Attorney, Agent, or Firm*—Lon H. Romanski

[57] ABSTRACT

A support element for an end of a board, intended for use in pairs to form a raised working platform or bench, comprises a first upwardly-facing support surface adapted to engage the underside of the board at its end, a second downwardly facing support surface parallel to and spaced vertically from the plane of the first supporting surface by a distance equal to the thickness of the board and spaced horizontally from the first supporting surface to engage the upper surface of the board a predetermined distance from its end, and at least one ground engaging surface so positioned that, in use, the support element engages the ground at a point directly below the first supporting surface, or a point spaced therefrom horizontally in the direction away from the second supporting surface.

17 Claims, 1 Drawing Sheet

SUPPORTING ELEMENT

The present invention relates to supporting elements, and is particularly concerned with providing a support for an end of a plank, board or the like on which workmen may stand to work above ground level.

It is common practice amongst building operatives to use materials commonly available on building sites to support the ends of a board when working at ceiling level, for example fixing ceiling panels, coving or plastering. Such structures, commonly comprising a plank resting on two oil drums or milk crates, or even on packing cases of disparate height, clearly leave much to be desired as regards the safety of the operatives and much time is lost in firstly the search for appropriate materials and secondly in the repeated need to reassemble the structure at intervals during the work.

The present invention seeks to provide an inexpensive robust and safe support element for a board end, which may be easily assembled to a board of standard width and thickness to provide a safe, raised working platform.

According to the present invention, a support element for an end of a board or the like comprises a first upwardly-facing support surface adapted to engage the underside of the board at its end, a second downwardly facing support surface parallel to and spaced vertically from the plane of the first supporting surface by a distance equal to the thickness of the board and spaced horizontally from the first supporting surface to engage the upper surface of the board a predetermined distance from its end, and at least one ground engaging surface so positioned that, in use, the support element engages the ground at a point directly below the first supporting surface, or a point spaced therefrom horizontally in the direction away from the second supporting surface.

In a preferred embodiment of the invention the support element comprises a pair of inclined parallel legs joined at their upper ends by a horizontal plate whose underside constitutes the second supporting surface, each leg having fixed to its side facing the other leg one of a pair of parallel horizontal bars spaced by a predetermined distance from the plate, the bars being joined at one end by an end stop extending in a vertical plane, and the lower ends of the legs terminating in horizontal surfaces either touching or extending through the said vertical plane.

In a second, alternative embodiment of the support element, the horizontal bars may be stepped so as to enable the support element to accommodate different thicknesses of board.

In yet another alternative, the support element may omit the end stop to allow the support element to be positioned at any point along a board.

To improve the lateral stability of the support element, the legs may be made to diverge downwardly over all or a part of their length, or laterally extending feet may be added on the lower ends of the legs.

An embodiment of the invention will now be described in detail with reference to the accompanying figures, in which.

Figure 2:
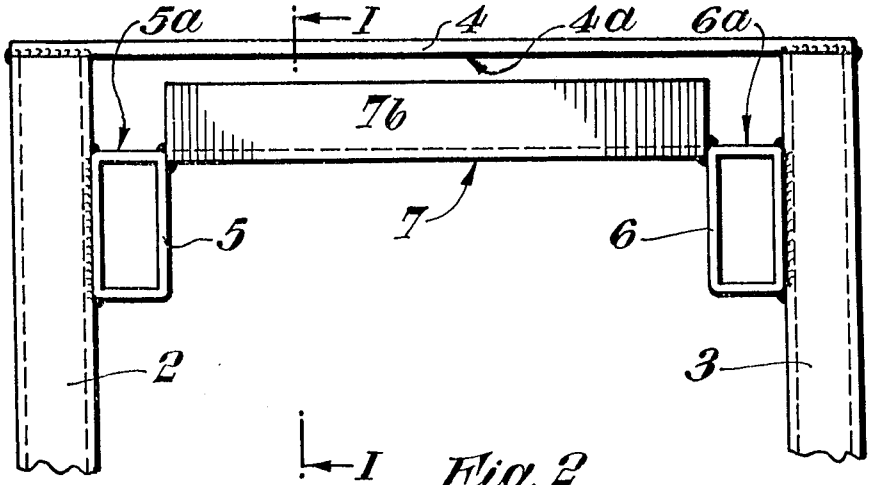
FIG. 2 shows a partial end view of the support element of FIG. 1.
Figure 1:
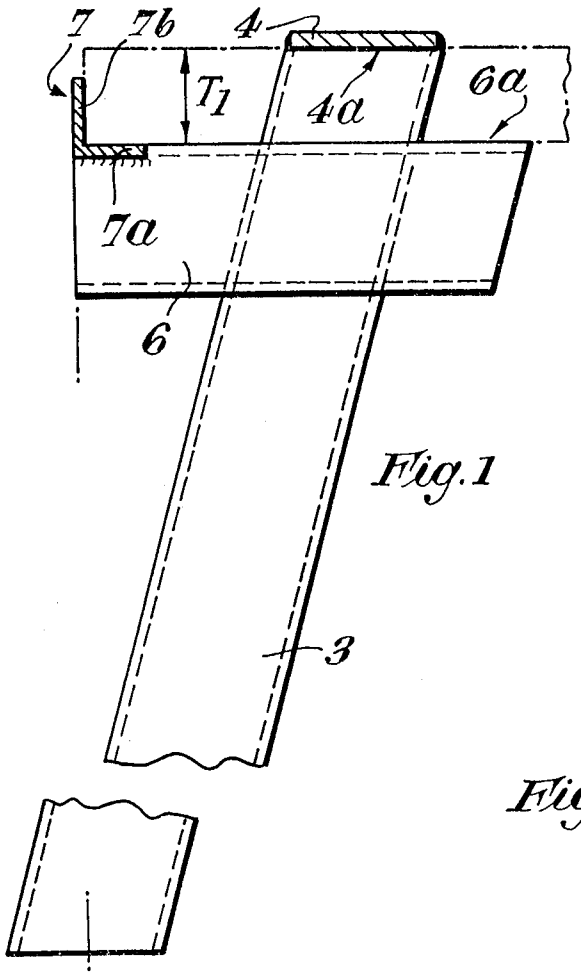
FIG. 1 shows a sectional side view of the support element in its working position.

Referring now to FIGS. 1 and 2, the support element 1 comprises two legs 2,3 joined by a top plate 4 at their upper ends. As will be clear, the legs in use are inclined at approximately 15° to the vertical and the top plate 4 is horizontal. Two bars 5,6 are fixed to respective facing sides of the legs 2,3 and extend horizontally out from the legs 2,3. The upper surfaces **5*a*,6*a* are spaced by a distance $T_1$ from the underside 4*a* of the top plate 4. An end stop 7 extends between respective ends of the bars 5 and 6, and comprises an angle section having a horizontal flange 7*a* flush with top surfaces 5*a*,6*a* of bars 5,6 and a vertical flange 7*b* upstanding therefrom. The legs 2,3 extend downwardly to terminate with the centre of each leg positioned in the plane of the vertical flange 7*b***.

In use, to erect a working platform a board of thickness $T_1$ is selected, the width of the board being less than or equal to the spacing between the legs 2,3 of the support element. The board is then simply inserted into the support element between the bars 5,6 and the top plate 4, until it occupies the position shown in phantom lines in FIG. 1 with the end of the board contacting the vertical flange **7*b* of end stop 7. The upper and lower surfaces of the board abut the underside 4*a* of the top plate 4 and the upper surface of flange 7*a* of the end stop 7 and the upper surfaces 5*a*,6*a* of the bars 5 and 6** respectively.

A second support element is then fitted in a similar way to the other end of the board and the board may then be used as a working platform.

Various features of the invention are worthy of emphasis. Firstly, the top plate 4 extends above the board and will warn an operative working on the board that he is approaching the end of the platform when the operative feels the top plate under his foot. It is a common occurrence with present structures that an operative will simply walk off the end of the board while his attention is devoted to the task in hand.

A second common source of danger is the present practice of siting the support (oil drum, crate etc.) at a point away from the end of the board. The operative may then progress along the board and on to the overhung section, with predictable results. The present support is so constructed that there can never be any overhang of the board past the support and thus this danger is eliminated.

Figure 3:
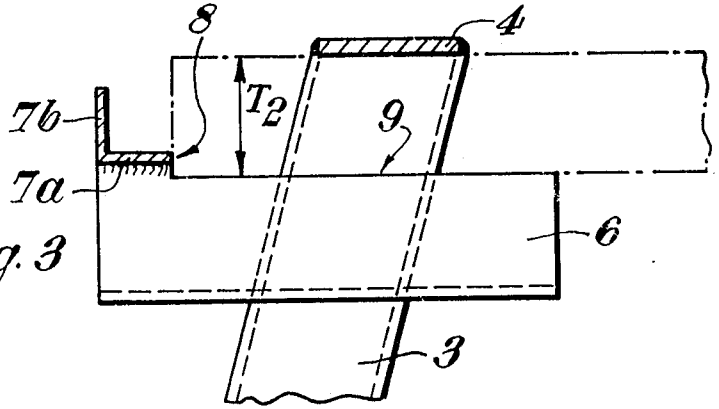
FIG. 3 is a partial sectional side view similar to FIG. 1 of a second embodiment of the invention.

In FIG. 3 there is shown a variant of the support element, in which the upper surfaces **5*a*,6*a* of the bars 5,6 are formed with a step 8 and a second, lower horizontal surface 9. It is to be understood that the second surface 9 is at least partially situated between the top plate 4 and the end stop 7. The purpose of this step is to allow the support to accommodate boards of two different thicknesses, the support being used in the manner described above with boards of a first thickness $T_1$, the board end contacting flange 7*b* of end stop 7 and flange 7*a* abutting the underside of the board. When a board of thickness $T_2$, greater than $T_1$, is used then the end of the board will contact the step 8 and the second surface 9 will engage the underside of the board. If desired, a crosspiece may be provided flush with second surface 9 to extend between the bars 5 and 6, so that boards having a width less than the spacing between bars 5 and 6** may be accommodated. Screw tightening elements may also be provided to grip the sides of the board, if desired.

In order to increase the versatility of the support element, it may be provided with telescopic legs to provide height adjustment. In the embodiment shown, the legs will be arranged so that at the lowest height adjustment the lower extremity of the leg is in the plane of the end stop flange *7b*, and when extended the lower end of the leg will extend beyond this plane. Rubber or other non-slip feet may be provided.

To provide a centre support for use on a longer board, to prevent undue sagging, the two end support elements may be supplemented by a third support element identical to the others, except that the upright flange *7b* is omitted, as is the step 8. Such a support element would be usable only with one thickness of board, but could be positioned at any point along the board to give central support.

The support elements described above are preferably of welded steel construction for durability, but if light weight is a requirement then aluminium or other suitable materials may be used.

I claim:

1. A support element for an elongate board or the like, comprising a first upwardly-facing support surface adapted to engage the underside of the board at its end, a second downwardly facing support surface parallel to and spaced vertically from the plane of the first supporting surface by a distance equal to the thickness of the board and spaced horizontally from the first supporting surface to engage the upper surface of the board a predetermined distance from its end, and at least one ground engaging surface so positioned that in use the support element engages the ground at a point directly below the first supporting surface or at a point spaced therefrom horizontally in the direction away from the second supporting surface, wherein a pair of legs are joined at one of their respective ends by a transversely extending plate, each of the legs having one of a pair of parallel bars fixed to it on its side adjacent the other leg, and the bars extending in a plane parallel to the plate and inclined to the axial direction of the legs, so that the side of the plate facing the bars constitutes the second supporting surface, and the sides of the bars nearest the plate consitute the first supporting surface.

2. A support element according to claim 1, wherein the bars are joined at one of their respective ends by a transverse member having a stop surface situated in a plane perpendicular to the bars and between the planes of the first and second supporting surfaces.

3. A supporting element according to claim 2, wherein the ends of the legs extend to intersect the plane of the stop surface.

4. A support element according to claim 1, wherein the parallel bars have steps formed in their sides adjacent the plate, to provide first supporting surfaces at two different spacings from the second supporting surface.

5. A support element according to claim 1, wherein the legs are adjustable in length.

6. A support element according to claim 1, wherein the legs are parallel.

7. A support element according to claim 1, wherein the legs diverge over at least a part of their length in the direction away from the plate.

8. A support element according to claim 1, in which laterally extending feet are formed at the ends of the legs remote from the plate.

9. A support element for an elongate board or the like comprising a pair of legs joined at one of their respective ends by a transverse member, and each leg having fixed to it on its side adjacent the other leg one of a pair of parallel bars extending generally transversely to the axial direction of the legs, the sides of the bars facing the transverse member constituting, in use, a first supporting surface engaging the underside of the board at its end, and the slide of the transverse member facing the bars constituting, in use a second supporting surface engaging the upper surface of the board at a distance from its end, and the end surfaces of the legs remote from the transverse member constituting, in use, ground-engaging surfaces positioned vertically below or beyond the end of the board.

10. A support element as claimed in claim 9, wherein the bars are inclined to the transverse direction of the legs, the legs being fixed to the bars at about the midpoints of the bars.

11. A support element according to claim 10 wherein the bars are joined at one of their respective ends by a second transverse member having a stop surface situated in a plane perpendicular to the bars and between the planes of the first and second supporting surfaces.

12. A supporting element according to claim 11 wherein the ends of the legs extend to intersect the plane of the stop surface.

13. A support element according to claim 9 wherein the parallel bars have steps formed in their sides adjacent the transverse member, to provide first supporting surfaces at two different spacings from the second supporting surface.

14. A support element according to claim 9 wherein the legs are adjustable in length.

15. A support element according to claim 9 wherein the legs are parallel.

16. A support element according to claim 9 wherein the legs diverge over at least a part of their length in the direction away from the transverse member.

17. A support element according to claim 9 in which laterally extending feet are formed at the ends of the legs remote from the transverse member.

* * * * *